US007470011B2

(12) United States Patent
Iwasaki

(10) Patent No.: US 7,470,011 B2
(45) Date of Patent: Dec. 30, 2008

(54) LIQUID DISCHARGING HEAD CARTRIDGE

(75) Inventor: Manabu Iwasaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 416 days.

(21) Appl. No.: 11/390,568

(22) Filed: Mar. 28, 2006

(65) Prior Publication Data

US 2006/0221149 A1 Oct. 5, 2006

(30) Foreign Application Priority Data

Mar. 31, 2005 (JP) ..... 2005-100848

(51) Int. Cl.
*B41J 2/175* (2006.01)

(52) U.S. Cl. ..... 347/85; 347/87

(58) Field of Classification Search ..... 347/85, 347/86, 87

See application file for complete search history.

(56) References Cited

U.S. PATENT DOCUMENTS 4,831,389 A * 5/1989 Chan ..... 347/86
5,262,802 A 11/1993 Karita et al.
5,905,518 A * 5/1999 DeFilippis ..... 347/85
5,940,104 A 8/1999 Karita et al.
6,267,473 B1 * 7/2001 Smith ..... 347/85
6,450,629 B2 * 9/2002 Childers ..... 347/85
6,705,712 B2 * 3/2004 Usui et al. ..... 347/86
6,786,581 B1 * 9/2004 Shinada et al. ..... 347/86
6,837,755 B1 * 1/2005 Kitajima et al. ..... 439/830
6,854,836 B2 * 2/2005 Ishinaga et al. ..... 347/85
6,908,180 B2 * 6/2005 Dietl ..... 347/85
6,935,739 B2 * 8/2005 Inoue et al. ..... 347/104
7,128,407 B2 * 10/2006 Inoue et al. ..... 347/85

* cited by examiner

*Primary Examiner*—Anh T. N. Vo
(74) *Attorney, Agent, or Firm*—Canon USA Inc IP Div

(57) ABSTRACT

A liquid discharging head cartridge that prevents a discharging head from being damaged due to exposure to liquid held in a liquid container during storage including the distribution period of a liquid discharging head cartridge, and ensures the reliability of the liquid discharging operation by the discharging head. An ink jet head cartridge includes an ink blocking member that is provided in the middle of an ink flow path and blocks ink supply to a recording head. The ink held in an ink container does not enter a section of the ink flow path between the ink blocking member and the recording head due to blockage by the ink blocking member.

5 Claims, 8 Drawing Sheets

LIQUID DISCHARGING HEAD CARTRIDGE

BACKGROUND OF THE INVENTION

1. Field of the Invention

The present invention relates to a liquid discharging head cartridge that is attached to and used in, for example, an ink jet recording apparatus and that includes a discharging head with an integral liquid container.

2. Description of the Related Art

There is known an integral ink jet head cartridge that includes a discharging head with an integral ink tank. The discharging head discharges ink to perform recording. The ink tank is connected to the recording head via an ink flow path.

In this integral ink jet head cartridge, the amount of ink dischargeable for printing is limited to the amount of ink held in the built-in ink tank. Therefore, printing durability of the recording head can be easily ensured compared to a separate ink tank system.

In general, when the integral ink jet head cartridge is distributed, the recording head is connected and communicates with the ink tank via the ink flow path. Therefore, the recording head is filled with the ink held in the ink tank. In order to prevent ink leakage from the recording head, in general, a sealing tape is attached to discharging ports of the recording head so as to seal the discharging ports (U.S. Pat. Nos. 5,262,802 and 5,940,104).

As described above, the conventional ink jet head cartridge is distributed with the recording head filled with ink. Therefore, the recording head is exposed to ink for prolonged periods. Therefore, components of the recording head can be dissolved by ink, and discharging performance can deteriorate. In addition, it is necessary that bonded parts and sealed parts that constitute the recording head do not deteriorate due to exposure to ink for prolonged periods. Moreover, it is necessary to consider the ink leakage from the recording head and the mixture of a plurality of color inks. It is requested to sufficiently ensure the reliability of the ink discharging characteristic after the storage period.

SUMMARY OF THE INVENTION

The present invention is directed to a liquid discharging head cartridge which ensures reliability of the ink discharging operation by a discharging head during storage including the distribution period of the liquid discharging head cartridge.

In an aspect of the present invention, a liquid discharging head cartridge detachably attachable to a cartridge mount includes a discharging head, a liquid container, a liquid flow path, and a liquid blocking member. The discharging head is configured to discharge liquid. The liquid container is adapted to hold liquid to be supplied to the discharging head. The liquid flow path connects the liquid container and the discharging head. The liquid blocking member is provided in the liquid flow path and blocks liquid supply to the discharging head. The liquid blocking member blocks the liquid so that the liquid does not enter a section of the liquid flow path between the liquid blocking member and the discharging head.

The present invention makes it possible to store a liquid discharging head cartridge without exposing a discharging head to liquid held in a liquid container. Therefore, the discharging head can be prevented from being damaged by the liquid during storage including the distribution period.

Further features of the present invention will become apparent from the following description of exemplary embodiments with reference to the attached drawings.

DESCRIPTION OF THE EMBODIMENTS

The embodiments of the present invention will now be described with reference to the drawings.

Figure 1:
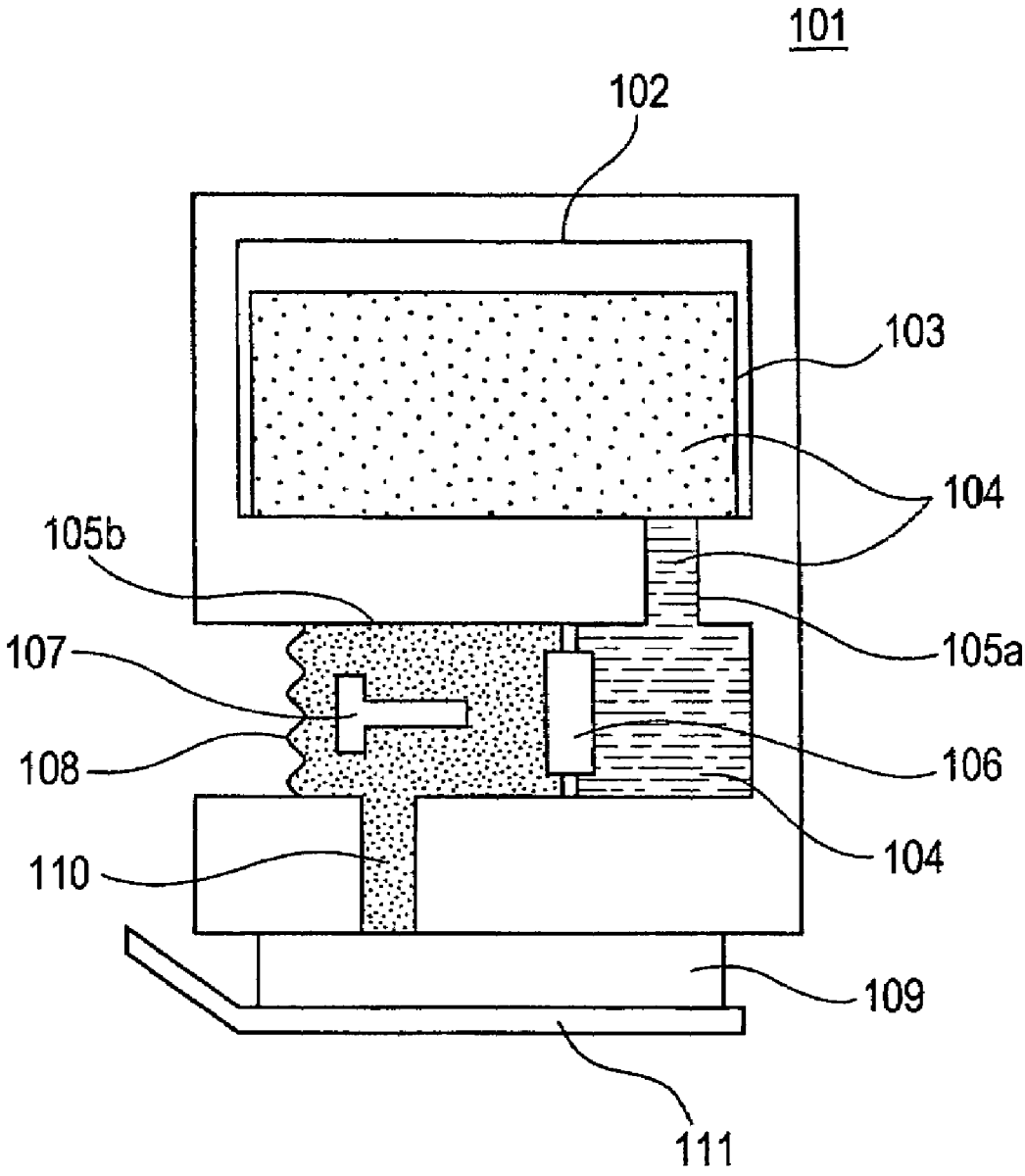
FIG. 1 is a sectional view schematically showing an ink jet head cartridge according to a first embodiment.

FIG. 1 is a sectional view schematically showing an ink jet head cartridge according to a first embodiment. In FIG. 1, an ink jet head cartridge 101 is not yet attached to a cartridge mount of an ink jet recording apparatus (not shown).

As shown in FIG. 1, the ink jet head cartridge 101 includes a recording head 109 that discharges ink drops and an ink container 102 that holds ink to be supplied to the recording head 109. In addition, the cartridge includes an upstream ink flow path 105*a* and a downstream ink flow path 105*b* that connect the ink container 102 and the recording head 109.

An ink absorber 103 that absorbs and holds ink is disposed in the ink container 102. The ink absorber 103 is filled with ink 104. An ink blocking member 106 that blocks ink supply from the ink container 102 to the recording head 109 is disposed between the upstream ink flow path 105*a* and the downstream ink flow path 105*b*.

The ink 104 fills the ink container 102 and the upstream ink flow path 105*a* disposed on the upstream side of the ink blocking member 106. A blockage removing member 107 for removing the blockage by the ink blocking member 106 is disposed in the downstream ink flow path 105*b*. The downstream ink flow path 105*b* and the blockage removing member 107 are sealed from the outside air by a rubber-like elastic film 108 serving as an operating member for moving the blockage removing member 107. This elastic film 108 seals an opening provided in the wall of the downstream ink flow path 105*b* and can be elastically deformed.

The downstream ink flow path 105*b* (the section of an ink flow path from the ink blocking member 106 to the recording head 109) and the recording head 109 are filled with head preserving liquid 110 different from the ink 104. Discharging ports (not shown) formed in the recording head 109 are sealed with a sealing tape 111. The head preserving liquid 110 can be put into the downstream ink flow path 105*b* through the discharging ports by reducing the pressure in the downstream ink flow path 105*b* through the discharging ports. Alternatively, the head preserving liquid 110 can be put into the downstream ink flow path 105*b* before the opening in the wall of the downstream ink flow path 105*b* is covered with the elastic film 108. Alternatively, the head preserving liquid 110 can be put into the downstream ink flow path 105*b* in the following way. First, a hole (not shown) communicating with the downstream ink flow path 105*b* is formed in the outer wall of the ink jet head cartridge 101. Through the hole, the head preserving liquid 110 is put into the downstream ink flow path 105*b*. Next, the hole is covered. The downstream ink flow path 105*b* need not necessarily be filled with the head preserving liquid 110. The downstream ink flow path 105*b* may be filled with a gas that does not harm the recording head 109, or air.

The ink jet head cartridge 101 of the present embodiment is in the blocked state shown in FIG. 1 during the storage period from the distribution period until the cartridge is attached to a cartridge mount of an ink jet recording apparatus. Therefore, during distribution, since the ink 104 is blocked by the ink blocking member 106, the ink 104 in the ink container 102 does not reach the insides of the nozzles of the recording head 109.

Figure 2A:
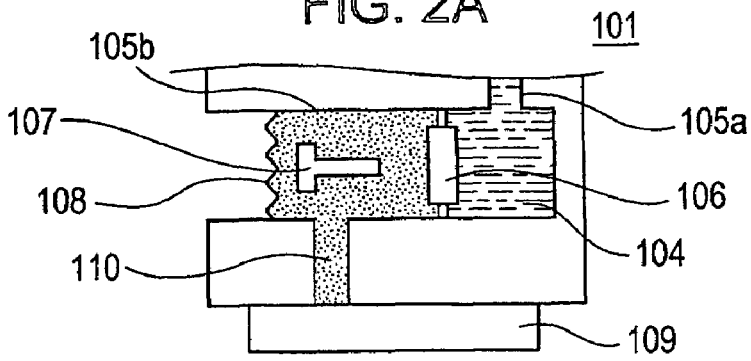
FIG. 2A is a sectional view schematically showing an ink blocking member and its vicinity.
Figure 2B:
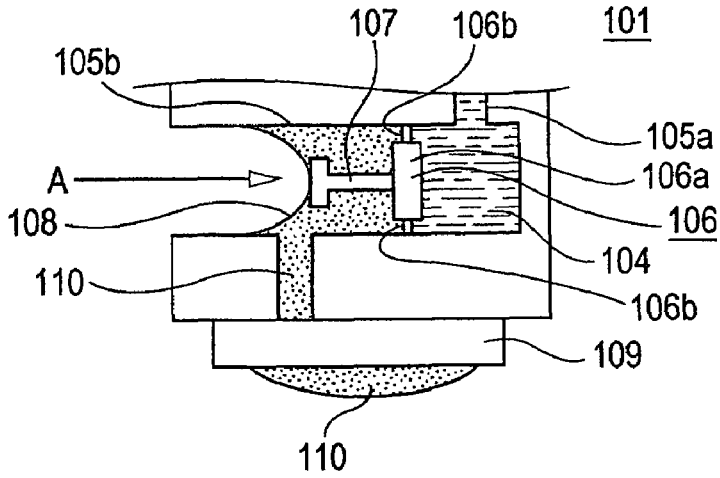
FIG. 2B is a sectional view schematically showing an ink blocking member and its vicinity.
Figure 2C:
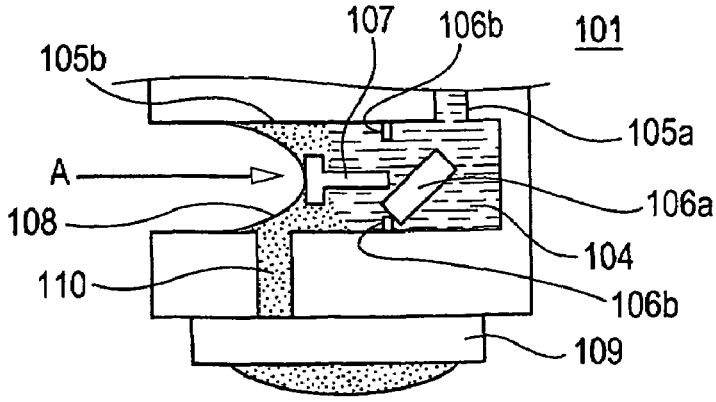
FIG. 2C is a sectional view schematically showing an ink blocking member and its vicinity.

FIGS. 2A, 2B, and 2C are sectional views schematically showing the ink blocking member 106 and its vicinity. In FIG. 2A, the sealing tape 111 shown in FIG. 1 is removed.

The ink blocking member 106 includes a central portion 106*a* that blocks the ink flow path and a peripheral portion 106*b* that fixes the central portion 106*a* to the inner surface of the ink flow path. The ink blocking member 106 can be formed by injection molding. The peripheral portion 106*b* is relatively thin. The central portion 106*a* is relatively thick.

The upstream ink flow path 105*a* is filled with the ink 104 supplied from the ink container 102. The downstream ink flow path 105*b* (the section of the ink flow path from the ink blocking member 106 to the recording head 109) is filled with the head preserving liquid 110.

First, the sealing tape 111 attached to the recording head 109 is removed. In FIG. 2B, the elastic film 108 is pressed in the direction of arrow A. The blockage removing member 107 is thereby pressed via the elastic film 108. The tip of the blockage removing member 107 comes into contact with the central portion 106*a* of the ink blocking member 106.

As shown in FIG. 2B, at this moment, the peripheral portion 106*b* of the ink blocking member 106 is fixed to the inner surface of the ink flow path. The flow of the ink 104 is blocked by the central portion 106*a* and the peripheral portion 106*b* between the upstream ink flow path 105*a* and the downstream ink flow path 105*b*.

Further pressing the elastic film 108 in the direction of arrow A in FIG. 2C reduces the volume of the downstream ink flow path 105*b*. The head preserving liquid 110 filling the downstream ink flow path 105*b* and nozzles (not shown) of the recording head 109 is thereby discharged from the discharging ports of the recording head 109 as shown in FIG. 2C.

In FIG. 2C, further pressing the blockage removing member 107 in the direction of arrow A breaks the peripheral portion 106*b* of the ink blocking member 106. Since the upstream ink flow path 105*a* is caused to communicate with the downstream ink flow path 105*b*, the ink 104 can be supplied from the ink container 102 to the recording head 109, and the ink jet head cartridge 101 becomes usable. Next, if necessary, the head preserving liquid 110 may be discharged from the nozzles of the recording head by a recovery operation.

In the present embodiment, distributing the ink jet head cartridge 101 in the state shown in FIG. 1 makes it possible to distribute without filling the recording head 109 with the ink 104. Distributing without exposing the recording head 109 to the ink 104 makes it possible to prevent the ink 104 from damaging the recording head 109. Operating the elastic film 108 as shown in FIGS. 2A, 2B, and 2C easily and surely makes the ink jet head cartridge 101 usable.

Figure 3A:
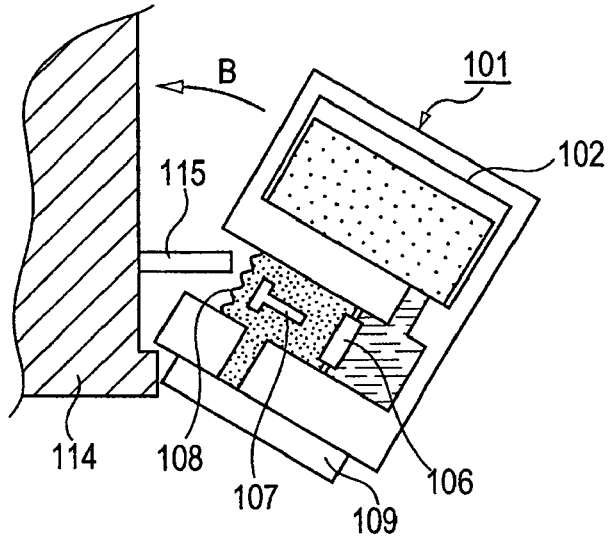
FIG. 3A is a schematic view showing how the ink jet head cartridge is attached to a cartridge mount.
Figure 3B:
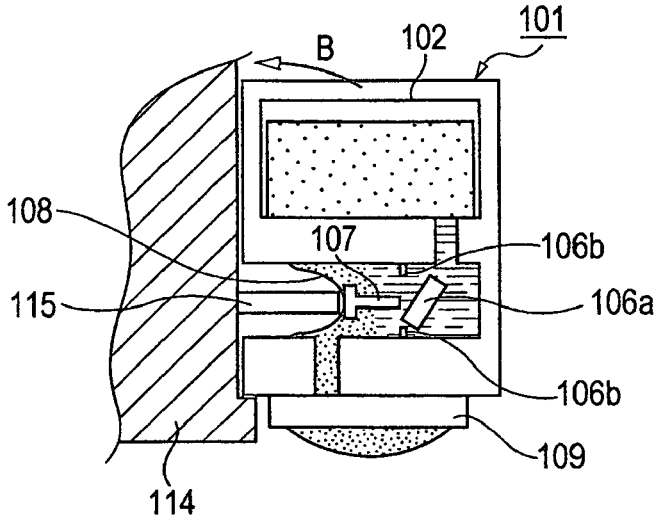
FIG. 3B is a schematic view showing how the ink jet head cartridge is attached to a cartridge mount.

FIGS. 3A and 3B are schematic views showing how the ink jet head cartridge 101 is attached to a cartridge mount 114 of an ink jet recording apparatus. In FIG. 3A, in order to attach the ink jet head cartridge 101 to the cartridge mount 114 of the ink jet recording apparatus, the lower end of the ink jet head cartridge 101 is brought into contact with an attaching guide formed in the cartridge mount 114. By rotating the ink jet head cartridge 101 in the direction of arrow B in FIG. 3A with the lower end in contact with the attaching guide, the ink jet head cartridge 101 is smoothly attached to the cartridge mount 114.

In FIG. 3B, the ink jet head cartridge 101 is attached to the cartridge mount 114 of the ink jet recording apparatus. An activating projection 115 serving as an activating member is provided in the cartridge mount 114. By rotating the ink jet head cartridge 101 in the direction of arrow B in FIG. 3A, the activating projection 115 comes into contact with the blockage removing member 107. The activating projection 115 then presses the ink blocking member 106 via the blockage removing member 107, and the peripheral portion 106*b* is thereby broken.

The above-described configuration makes it possible to activate the blockage removing member 107 in conjunction with the operation of attaching the ink jet head cartridge 101 to the cartridge mount 114, and easily and surely removing the blockage by the ink blocking member 106.

Although not shown, a removing mechanism for removing the blockage by the ink blocking member 106 may be provided in the cartridge mount 114. In this case, after the ink jet head cartridge 101 is attached to the cartridge mount 114, the removing mechanism is driven, and the blockage removing member 107 is moved by the removing mechanism and is thereby activated.

As described above, since the blockage is removed in conjunction with the operation of attaching the ink jet head cartridge 101 to the cartridge mount 114, the user can be effectively prevented from using the recording apparatus without removing the ink blocking member 106. In addition, since the blockage removing member 107 is disposed at the back of the ink jet head cartridge 101, that is to say, at a position apart from the outer part, the user can be prevented from accidentally touching and activating the blockage removing member 107. If necessary, of course, the user can activate the blockage removing member 107 by pressing the blockage removing member 107 via the elastic film 108 using, for example, an activating pin (not shown).

Figure 3C:
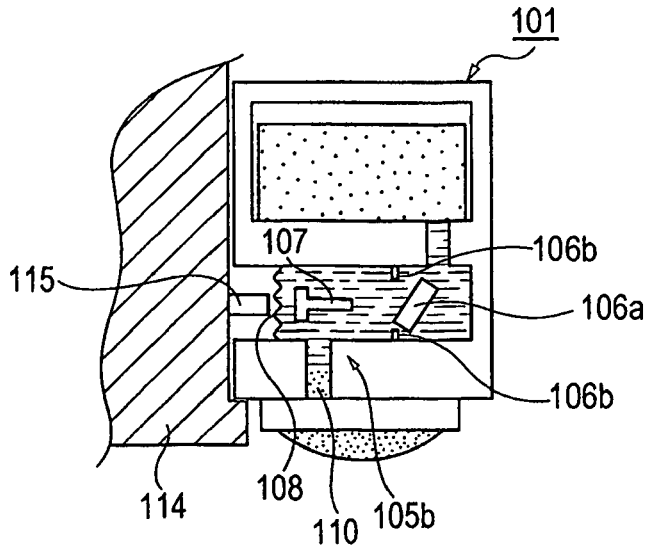
FIG. 3C is a schematic view showing how the ink jet head cartridge is attached to a cartridge mount.

In FIG. 3C, after the activating projection 115 breaks the peripheral portion 106*b*, the activating projection 115 shortens.

Since the elastic film 108 sealing the downstream ink flow path 105*b* is an elastic body, when the pressing force exerted from the activating projection 115 is gone, the elastic film 108 returns to its initial state and returns the volume of the downstream ink flow path 105*b* to the initial state. At this moment, since the elastic film 108 returns to the initial state, the volume of the downstream ink flow path 105*b* increases, and the ink 104 in the ink container 102 moves toward the downstream ink flow path 105*b*.

Consequently, the head preserving liquid 110 in the downstream ink flow path 105*b* is pressed by the ink 104 toward the recording head 109. The head preserving liquid 110 is thus smoothly replaced with the ink 104.

Therefore, in the ink jet head cartridge 101, after the blockage by the ink blocking member 106 is removed, the ink 104 is well supplied from the ink container 102 to the recording head 109.

As described above, since the ink blocking member 106 is provided between the upstream ink flow path 105*a* and the downstream ink flow path 105*b*, the recording head 109 is not exposed to the ink 104 during the distribution period, and the reliability of the ink discharging operation can be ensured after the distribution period. In addition, since the cartridge includes the blockage removing member 107 that removes the blockage by the ink blocking member 106, the blockage by the ink blocking member 106 can be easily and surely removed after the distribution period.

Figure 4:
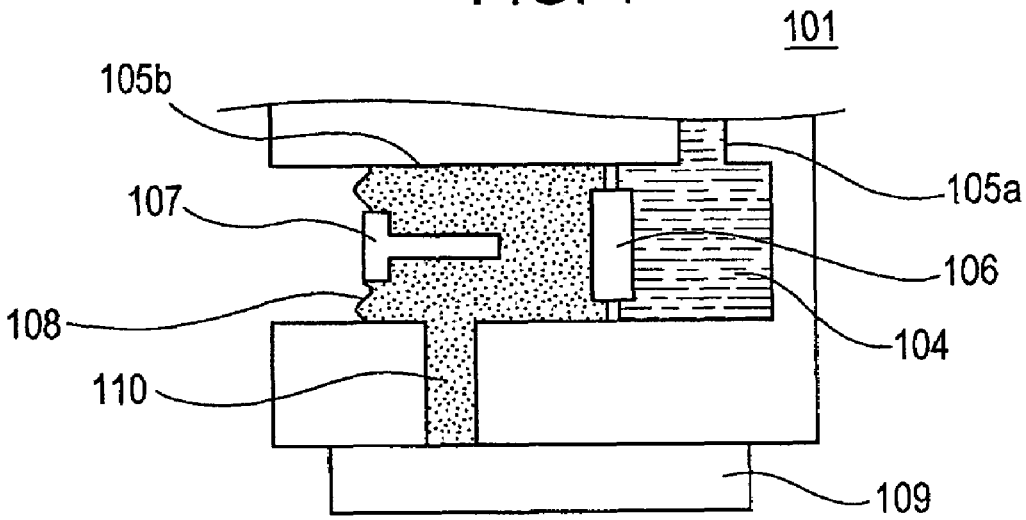
FIG. 4 is a sectional view schematically showing an ink blocking member and its vicinity according to a second embodiment.

FIG. 4 is a sectional view schematically showing an ink blocking member and its vicinity of an ink jet head cartridge according to a second embodiment. As shown in FIG. 4, one end of the blockage removing member 107 may be joined to the elastic film 108. The configuration of the present embodiment makes it possible to displace the blockage removing member 107 in quick response to the displacement of the elastic film 108. Therefore, the ink blocking member 106 can be surely removed.

Figure 5:
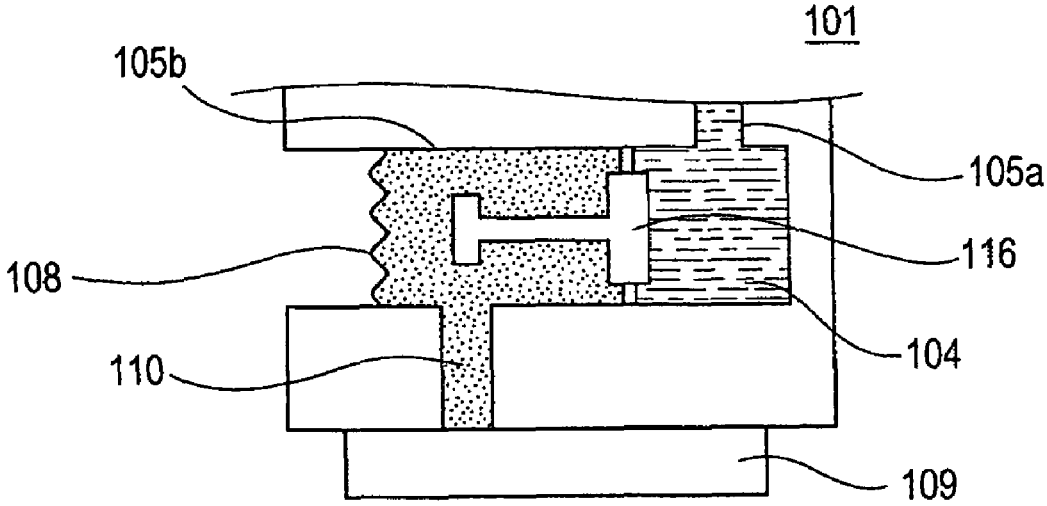
FIG. 5 is a sectional view schematically showing an ink blocking member and its vicinity according to another form of the second embodiment.

Alternatively, as shown in FIG. 5, the blockage removing member 107 may be integrated with the ink blocking member 116. The same advantage can be obtained.

Figure 6A:
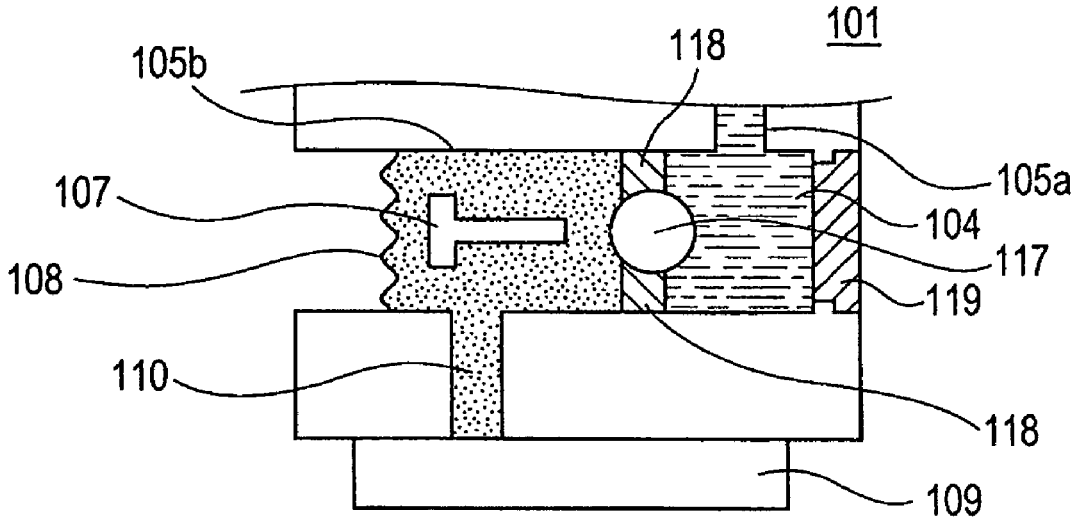
FIG. 6A is a sectional view schematically showing an ink blocking member and its vicinity according to a third embodiment.
Figure 6B:
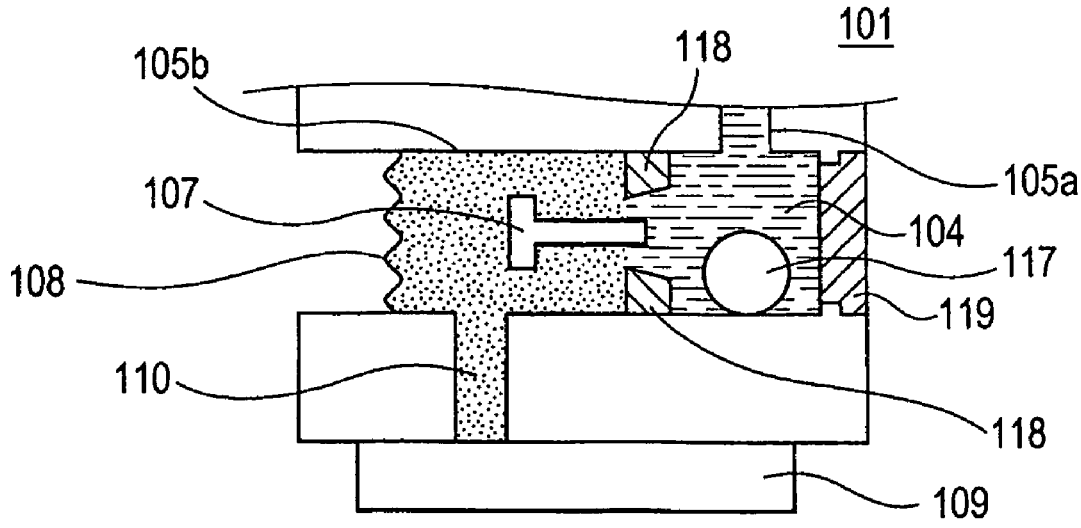
FIG. 6B is a sectional view schematically showing an ink blocking member and its vicinity according to a third embodiment.

FIGS. 6A and 6B are sectional views schematically showing an ink blocking member and its vicinity of an ink jet head cartridge according to a third embodiment.

In FIG. 6A, ink supply to the recording head is blocked by a liquid blocking member. A spherical ink blocking member 117 and a peripheral part 118 that fixes the ink blocking member 117 to the inner surface of the ink flow path are disposed between the upstream ink flow path 105*a* and the downstream ink flow path 105*b*. The ink blocking member 117 is installed in the following way, for example. First, an opening (not shown) is provided in the ink jet head cartridge. Through the opening, the ink blocking member 117 is pressed in the peripheral part 118. Next, the opening is closed with a cover 119. The upstream ink flow path 105*a* is filled with the ink 104 supplied from the ink container. The ink blocking member 117 and the peripheral part 118 block the supply of ink 104 to the recording head 109.

As shown in FIG. 6B, pressing the blockage removing member 107 and causing the blockage removing member 107 to separate from the peripheral part 118 causes the upstream ink flow path 105*a* to communicate with the downstream ink flow path 105*b*. This makes it possible to supply the ink 104 from the ink container to the recording head 109, and the ink jet head cartridge 101 becomes usable.

Figure 7A:
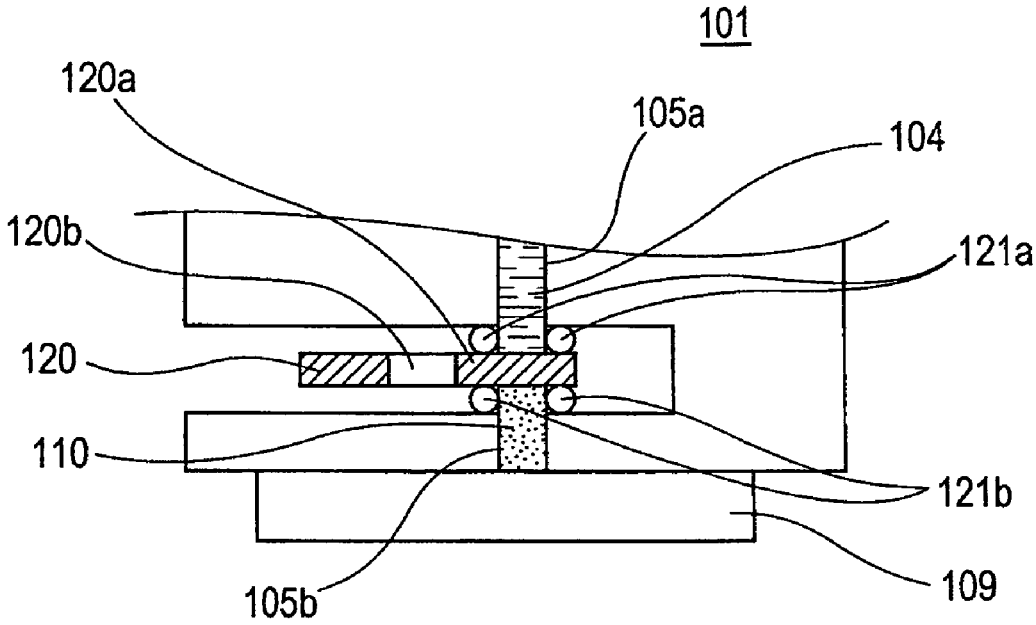
FIG. 7A is a sectional view schematically showing an ink blocking member and its vicinity according to a fourth embodiment.
Figure 7B:
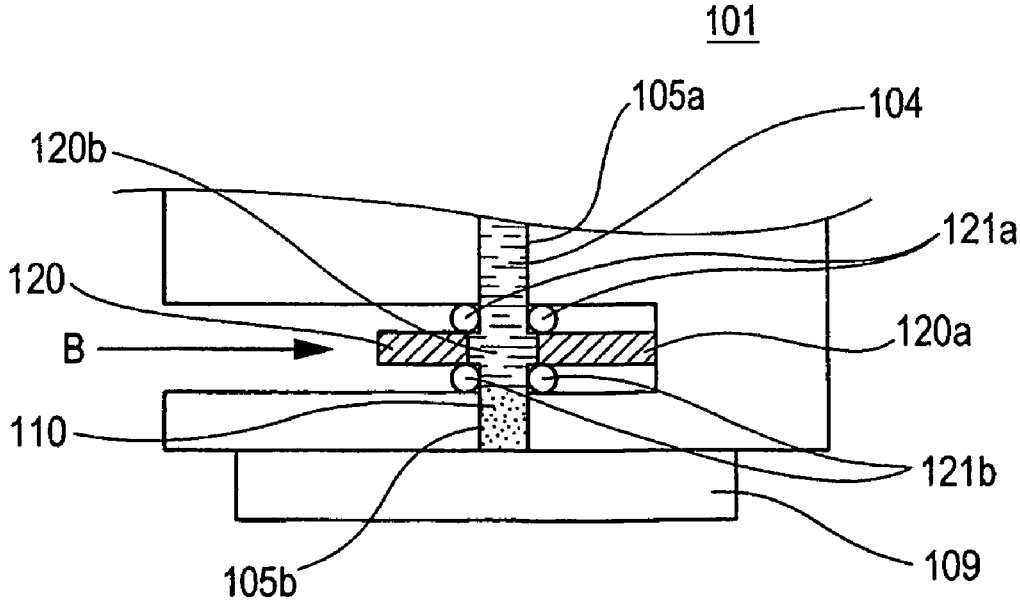
FIG. 7B is a sectional view schematically showing an ink blocking member and its vicinity according to a fourth embodiment.

FIGS. 7A and 7B are sectional views schematically showing an ink blocking member of an ink jet head cartridge and its vicinity according to a fourth embodiment.

In FIG. 7A, ink supply to the recording head is blocked by a liquid blocking member. Between the upstream ink flow path 105*a* and the downstream ink flow path 105*b*, there are disposed a plate-shaped ink blocking member 120 and sealing members 121*a* and 121*b*. The upstream ink flow path 105*a* is filled with the ink 104 supplied from the ink container. A blocking part 120*a* of the ink blocking member 120 is in contact with the upstream ink flow path 105*a* with the sealing members 121*a* between them, thereby blocking ink supply to the recording head 109.

As shown in FIG. 7B, the ink blocking member 120 is pressed in the direction of arrow B. An opening 120*b* is caused to communicate with the upstream ink flow path 105*a*. The upstream ink flow path 105*a* is thus caused to communicate with the downstream ink flow path 105*b* via the opening 120*b*. In the present embodiment, a blockage removing member (not shown) is provided in the cartridge mount. This makes it possible to supply the ink 104 from the ink container to the recording head 109, and the ink jet head cartridge 101 becomes usable.

Figure 8A:
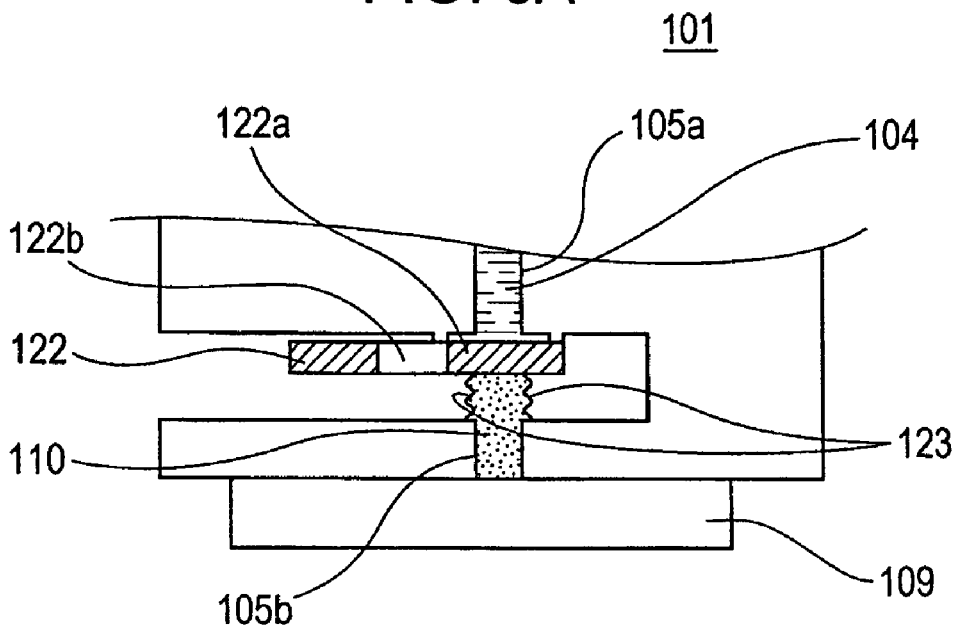
FIG. 8A is a sectional view schematically showing an ink blocking member and its vicinity according to a fifth embodiment.
Figure 8B:
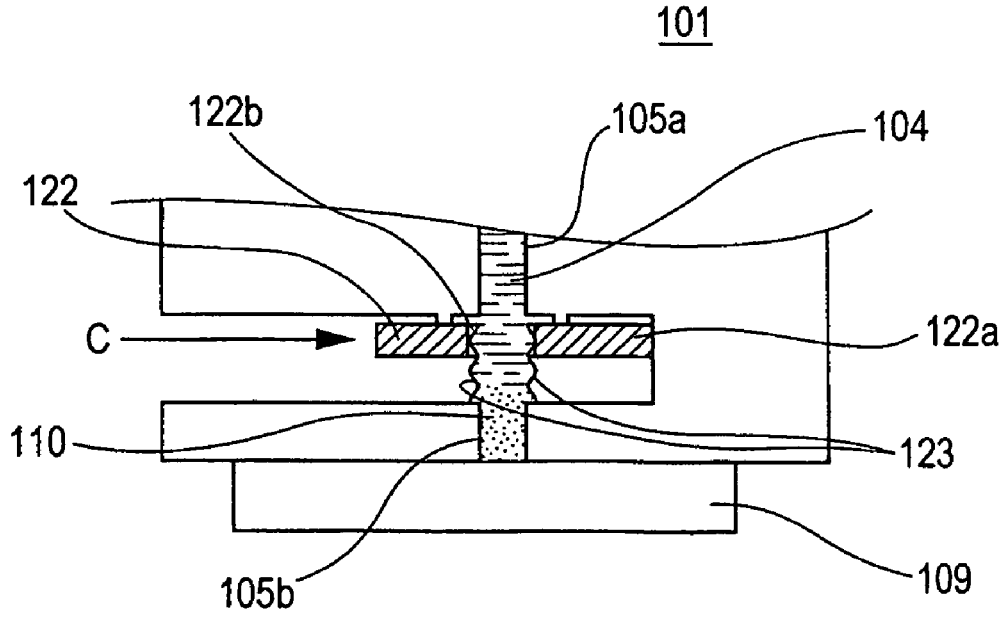
FIG. 8B is a sectional view schematically showing an ink blocking member and its vicinity according to a fifth embodiment.

FIGS. 8A and 8B are sectional views schematically showing an ink blocking member of an ink jet head cartridge and its vicinity according to a fifth embodiment.

In FIG. 8A, ink supply to the recording head is blocked by a liquid blocking member. Between the upstream ink flow path 105*a* and the downstream ink flow path 105*b*, a plate-shaped ink blocking member 122 and an accordion ink flow path 123. At this moment, the accordion ink flow path 123 is compressed. The upstream ink flow path 105*a* is filled with the ink 104 supplied from the ink container. A blocking part 122*a* of the ink blocking member 122 is in contact with the upstream ink flow path 105*a*, thereby blocking ink supply to the recording head 109.

As shown in FIG. 8B, a blockage removing member provided in the cartridge mount presses the ink blocking member 122 in the direction of arrow C, thereby allowing the accordion ink flow path 123 to pass through an opening 122*b*. The accordion ink flow path 123 extends toward the upstream ink flow path 105*a*. The upstream ink flow path 105*a* is connected with the accordion ink flow path 123. Consequently, the upstream ink flow path 105*a* communicates with the downstream ink flow path 105*b* via the accordion ink flow path 123. This makes it possible to supply the ink 104 from the ink container to the recording head 109, and the ink jet head cartridge 101 becomes usable.

Figure 9A:
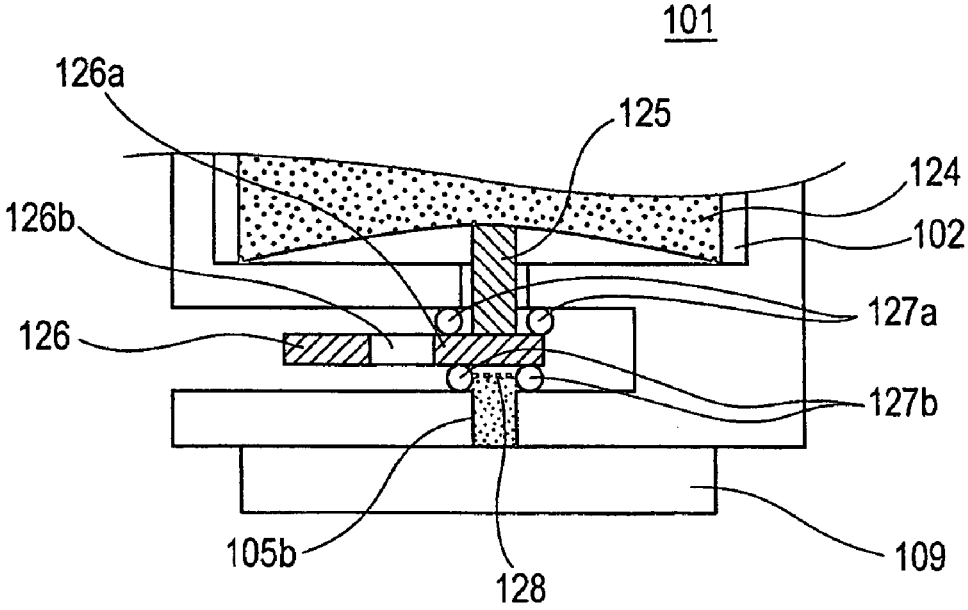
FIG. 9A is a sectional view schematically showing an ink blocking member and its vicinity according to a sixth embodiment.
Figure 9B:
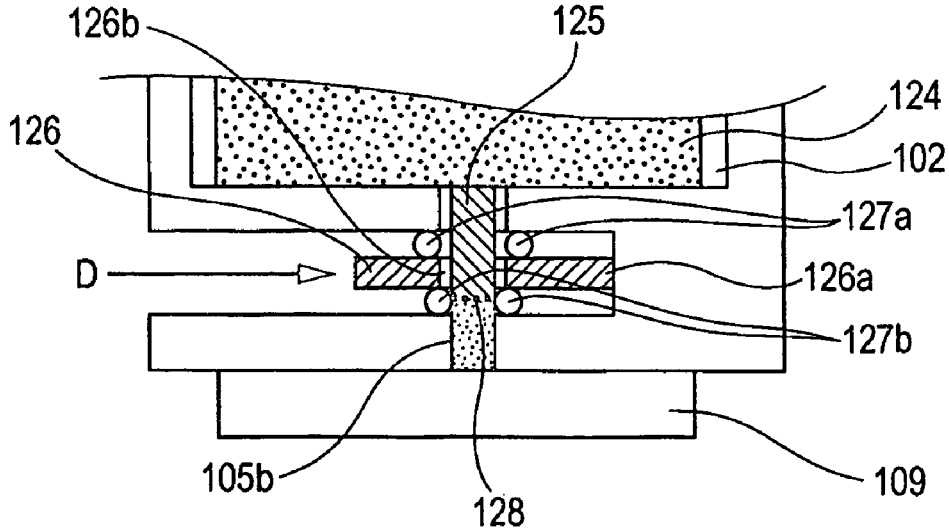
FIG. 9B is a sectional view schematically showing an ink blocking member and its vicinity according to a sixth embodiment.

FIGS. 9A and 9B are sectional views schematically showing an ink blocking member of an ink jet cartridge and its vicinity according to a sixth embodiment.

In FIG. 9A, ink supply to the recording head is blocked by a liquid blocking member. Ink is held in an ink absorber 124 disposed in the ink container 102. A presser 125 is in contact with the ink absorber 124, holds ink, and functions as an upstream ink flow path. Between the presser 125 and a filter 128, there are disposed an ink blocking member 126 and sealing members 127*a* and 127*b*. The ink absorber 124 is elastic and presses the presser 125 against the ink blocking member 126. The filter 128 is provided in the downstream ink flow path 105*b*. A blocking part 126*a* of the ink blocking member 126 is disposed between the presser 125 and the filter 128, thereby blocking ink supply to the recording head 109.

As shown in FIG. 9B, the ink blocking member 126 is pressed in the direction of arrow D. The presser 125 is allowed to pass through an opening 126*b*. The presser 125 is pressed by the ink absorber 124 and brought into contact with the filter 128. Since the presser 125 is in contact with the filter 128, the ink 104 can be supplied to the recording head 109 through the presser 125 and the filter 128. The ink jet head cartridge 101 thus becomes usable.

In the present embodiment, the ink absorber 124 or the presser 125 or both are elastic so that the presser 125 is pressed against the ink blocking member 126. Alternatively, a mechanism such as a spring may be used to exert force on the presser 125.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-100848 filed Mar. 31, 2005, which is hereby incorporated by reference herein in its entirety.

What is claimed is:

1. A liquid discharging head cartridge detachably attachable to a cartridge mount, comprising:

a discharging head configured to discharge liquid;

a liquid container adapted to hold liquid to be supplied to the discharging head;

a liquid flow path that connects the liquid container and the discharging head;

a liquid blocking member blocking liquid supply to the discharging head and provided in the liquid flow path, wherein the liquid blocking member blocks the liquid so that the liquid does not enter a section of the liquid flow path between the liquid blocking member and the discharging head; and a blockage removing member facilitating removing the blockage by the liquid blocking member, wherein the blockage removing member presses the liquid blocking member to remove the blockage, and further comprising an operating member moving the blockage removing member in a direction in which the blockage removing member presses the liquid blocking member.

2. The liquid discharging head cartridge according to claim 1, wherein the operating member is activated by an activating member provided in the cartridge mount, in conjunction with an operation to attach the liquid discharging head cartridge to the cartridge mount.

3. The liquid discharging head cartridge according to claim 1, wherein the operating member reduces a volume of the section of the liquid flow path between the liquid blocking member and the discharging head when the blockage removing member is activated.

4. The liquid discharging head cartridge according to claim 3, wherein the operating member increases the volume after reducing the volume.

5. A liquid discharging head cartridge detachably attachable to a cartridge mount, comprising:

a discharging head configured to discharge liquid;

a liquid container adapted to hold liquid to be supplied to the discharging head;

a liquid flow path that connects the liquid container and the discharging head; and a liquid blocking member blocking liquid supply to the discharging head and provided in the liquid flow path, wherein the liquid blocking member blocks the liquid so that the liquid does not enter a section of the liquid flow path between the liquid blocking member and the discharging head, and wherein the section of the liquid flow path between the liquid blocking member and the discharging head is filled with liquid different from the liquid held in the liquid container.

* * * * *